US007118402B2

(12) United States Patent
Takada

(10) Patent No.: US 7,118,402 B2
(45) Date of Patent: Oct. 10, 2006

(54) ELECTRICAL CONNECTOR ASSEMBLY

(75) Inventor: Toshiyuki Takada, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 10/826,513

(22) Filed: Apr. 19, 2004

(65) Prior Publication Data

US 2004/0214465 A1 Oct. 28, 2004

(30) Foreign Application Priority Data

Apr. 25, 2003 (JP) ..... 2003-121742

(51) Int. Cl.
*H01R 13/625* (2006.01)

(52) U.S. Cl. ..... 439/341; 439/953

(58) Field of Classification Search ..... 439/76.1, 439/341, 378, 953
See application file for complete search history.

(56) References Cited

U.S. PATENT DOCUMENTS 5,458,497 A * 10/1995 Yasumura et al. ..... 439/62
6,535,397 B1 * 3/2003 Clark et al. ..... 361/788

FOREIGN PATENT DOCUMENTS

JP 2001-143786 5/2001

OTHER PUBLICATIONS

European Search Report, Dec. 22, 2005.

* cited by examiner

*Primary Examiner*—Khiem Nguyen
(74) *Attorney, Agent, or Firm*—Takeuchi&Kubotera,LLP

(57) ABSTRACT

An electrical connector assembly comprises first and second connectors (20 and 40), each having contact portions arranged in a direction perpendicular to the plugging direction. The first connector (20) has a pair of guide portions (36) provided at sides thereof and each having guide surfaces (36A and 36B). The second connector comprises (40) has a pair of guided portions (41), each having a guided surface (41A) which is guided by the guide surface when the second connector is plugged into the first connector. At least one of the guide and guided surfaces has a relief recess (36C and 41C) in a middle thereof to permit large inclination of the second connector with respect to the first connector when the second connector is removed from the first connector.

7 Claims, 7 Drawing Sheets

ELECTRICAL CONNECTOR ASSEMBLY

BACKGROUND OF THE INVENTION

1. Field of the Invention

The present invention relates to an electrical connector assembly.

2. Description of the Related Art

Japanese Patent Application Kokai Number 2001-143786 (FIG. 1) discloses an electrical connector assembly for connecting a plurality of circuit boards, in which an intermediate board is used.

An electrical connector assembly disclosed in the above Patent Document comprises, as shown in FIG. 6, a connector 50, which is fixed, and a mating connector 70, which is plugged into and removed from the connector 50 for electrical connection and disconnection.

(The connector 50)

The connector 50 is an intermediate connector which is made substantially symmetric vertically so that the mating connector 70 and another connector 80 having the similar structure as the mating connector 70 are connected to the connector 50 in opposite directions. The connectors 70 and 80 are usually connected to corresponding circuit boards extending in a plane perpendicular to the sheet of the drawing and the connector 50 is used for connecting these circuit boards. Since the connector 80 is fixed to an apparatus, when the connector 80 is plugged into the connector 50, the connector 80 is locked. Accordingly, for disconnection between both the circuit boards, the connector 70 is usually unplugged from the connector 50.

The connector 50 comprises an intermediate board 51 and a guide frame 52 for supporting the intermediate board 51. As shown in FIG. 6, a plurality of connection portions 53 (connection pads) are arranged laterally along upper and lower edges of the intermediate board 51. Circuit traces (not shown) are provided in the inner layer of the intermediate board 51 and connected to the connection portions 53. A thin-plate-like shield 54 is provided on substantially whole area between the upper and lower contact portions 53 to shield the circuit traces in the inner layer of the intermediate board 51. The shield 54 is connected to some of the contact portions 53. An engagement hole 55 is provided in the center of the intermediate board 51 to engage a projection 60 (described below) provided in the guide frame 52.

The guide frame 52 comprises a substantially plate-like support portion 56 for supporting the intermediate board 51 and a pair of columns which are integrally provided with the support portion 56 at ends in the lateral direction of the support portion 56.

The support portion 56 has a supporting surface for coming in contact with and supporting a substantially whole area of one face (back face in FIG. 6) of the intermediate board 51, and the projection 60 for engaging the engagement hole 55 and positioning the intermediate board 51. Each of columns has a holding portion 57 for supporting ends of the intermediate board 51 in the lateral direction and a pole-like guide portion 58 extending in the plugging direction and guiding the mating connector 70 in the plugging direction.

The guide portion 58 has a guide surface 59, a flat surface extending in the plugging direction of the mating connector 70 outside the area in which the contact portions of the intermediate board 51 are arranged. The flat surface of the guide surface 59 extends in substantially whole range of the area projecting from the edge of the intermediate board 51 in the plugging direction. The guide portion 58 guides the mating connector 70 with the guide surface 59 guiding a guided surface 74 (described below) of the mating connector 70.

(The Mating Connector 70)

The mating connector 70 comprises a housing 71, an accommodation cavity 72 provided in the housing 71 for receiving the upper edge of the intermediate board 51 in which the contact portions 53 are arranged, and a pair of hole-like guided portions 73 which are provided in the housing 71 and guided by the guide portions 58 of the guide frame 52 when the connector 70 is connected to the connector 50. A plurality of resilient contact portions of terminals (not shown) are provided in the accommodation cavity 72 at positions corresponding to those of the contact portions 53 of the intermediate board 51 so that resilient contact portions are brought into resilient contact with the contact portions 53 when the connector 70 is connected to the connector 50. The terminals extend outwardly from the opposite side of an opening of the accommodating cavity 72. The terminals have a plurality of contact portions on the opposite side which are connected by soldering to corresponding circuit traces of a circuit board (not shown) provided in a direction perpendicular the intermediate board 51.

Each of the guided portions 73 has the guided surface 74 which faces to the guide surface 59 closely when the connector 70 is connected to the connector 50 (FIGS. 6 and 7).

(Connection between both the Connectors)

As described above, the resilient contact portions of the terminals of the connector 70 are connected to the contact portions 53 provided in the upper edge of the connector 50 when the connector 70 is guided in the plugging direction. The connector 80 is also connected to the lower edge of the connector 50 in the similar way. That is, any of the connectors 70 and 80 can be a mating connector of the connector 50. Accordingly, the connectors 70 and 80 are electrically connected to each other through the connector 50. Consequently, the two circuit boards attached to the connectors 70 and 80 are electrically connected to each other under the condition that they are perpendicular to the intermediate board 51.

When disconnecting the connector 70 from the connector 50, the connector 70 is pulled out from the connector 50.

When removing the connector 70 from the connector 50, the connector 70 should not be pulled by force because the guide surface 59 and the guided surface 74 face to each other closely.

Actually, however, the connector 70 is frequently pulled by force. Especially, when the circuit board is attached to the connector 70, since the connector 70 is hidden behind the circuit board, the condition of the connector 70 is not visible accurately. Accordingly, when the connector 70 is attempted to be pulled out from the connector 50, an edge of the circuit board is grasped and the connector 70 is gouged. Under the condition, since the distance between the edge of the circuit board and the connector 70 is relatively large, the gouging force is large. The connector 70 is gouged repeatedly, being tilted in the right and left direction alternately.

When the connector 70 is gouged, as shown in FIG. 7 showing the left-hand guide portion 58, the guided surface 74 of the guided portion 73 of the connector 70 is tilted with respect to the guide surface 59 of the guide portion 58 of connector 50. Since the guide surface 59 is in close to the guided surface 74, the gap between them is small. Accordingly, if the connector 70 is gouged over the gap, the lower edge of the guided surface 74 is strongly pressed to the guide surface 59. As the result, a large force is applied to the guided and guide portions 73 and 58 and the lower edge of the guided surface 74 may bite the guide surface 59.

When the above-described large force is applied, the guide portion 58 or the guided portion 73 may be damaged, or the soldering portions between the connector 70 and the circuit board are damaged resulting in connection defective. Also, when the lower edge of the guided surface 74 bites the guide surface 59, it may be difficult to pull out the connector 70 from the connector 50.

In addition, if the removal operation of the connector 70 is finished under the condition that, for example, only the right-hand guided portion 73 in FIG. 6 is removed from the guide portion 58 and the left-hand guided portion 73 still stands in the other guide portion 58 shallowly, the connector 70 is inclined largely. In this case, since the right-hand guide portion 73 is already removed from the guide portion 58, the connector 70 rotates largely by the weight of the circuit board, which produces a force much larger than the gouging force. Accordingly, the guide portion 58 and so forth is readily damaged. Even if it does not cause the damage, the lower edge of the guided surface 74 may bite the guide surface 59, which makes it difficult for the connector 70 to be removed from the connector 50.

SUMMARY OF THE INVENTION

Accordingly, it is an object of the present invention to provided an electrical connector assembly capable of disconnecting connectors without damage and bite of the connectors.

According to an aspect of the present invention, there is provided an electrical connector assembly in which a first connector and a second connector are plugged to each other for electrical connection. The first connector comprises a plurality of first contact portions arranged in a direction perpendicular to a plugging direction of the first and second connectors and a pair of guide portions provided at sides of the first connector outside a range, in which the contact portions are arranged, each having a guide surface extending in a plane perpendicular to the direction in which the first contact portions are arranged. The second connector comprises a plurality of second contact portions arranged in the direction and connected to the first contact portions and a pair of guided portions each having a guided surface guided by the guide surface when the second connector is plugged into the first connector.

At least one of the guide and guided surfaces has a relief recess at least in a middle thereof in the plugging direction.

In this electrical connector assembly, when the second connector is removed from the first connector, shortly after the removal operation, the edge portion of the guided surface of the guided portion enters the relief recess. Consequently, a large inclination between the two connectors is secured, permitting large gouging. Accordingly, the second connector is removed from the first connector smoothly with any large force applied to the guide and guided portions or without any bite of the edge portion of the guided surface into the guide surface. Also, the guide and guided portions do not receive any damage and the soldered portion between the connector and the circuit board is not damaged, thus producing no connection defective.

It is preferred that at least one of the guide portions of the first connector has an asymmetric shape with respect to a line connecting the pair of the guide portions and the guided portions of the second connector have shapes corresponding to those of the guide portions. The mis-plugging of the second connector into the first connector is prevented because of the asymmetric shape of the guide portion.

It is preferred that at least inside surface of a top of each of the guide portions is tapered in at least the direction in which the contact portions are arranged.

If the inside top of the guide portion is tapered, when one of the two guided portions, for example, the right guided portion is removed from the right guide portion and the left guided portion is still in the left guide portion shallowly, the above-described taper permits the inclination of the second connector further more.

BRIEF DESCRIPTION OF THE DRAWINGS

FIGS. 2(A) and 2(B) are enlarged sectional views of a guide portion and a guided portion of the two connectors of FIG. 1, wherein FIG. 2(A) shows a plugging condition between the two connectors and FIG. 2(B) shows a condition in the middle of removal of one connector from the other.

FIGS. 3(A) and 3(B) are perspective views showing another embodiment of the present invention, wherein FIG. 3(A) shows two guide portions and FIG. 3(B) shows a modification of one of the guide portions of FIG. 3(A).

FIGS. 4(A) and 4(B) are enlarged sectional views of the guide portion and a guided portion of two connectors according to another embodiment, wherein FIG. 4(A) shows a plugging condition between the two connectors and 4(B) shows a condition in the middle of removal of one connector from the other.

FIGS. 5(A) and 5(B) are enlarged sectional views of a guide portion and a guided portion of two connectors according to still another embodiment, wherein FIG. 5(A) shows a plugging condition between the two connectors and FIG. 5(B) shows a condition in the middle of removal of one connector from the other.

DESCRIPTION OF THE PREFERRED EMBODIMENTS

Embodiments of the present invention will now be described below with reference to the accompanying drawings, FIGS. 1–5.

Figure 1:
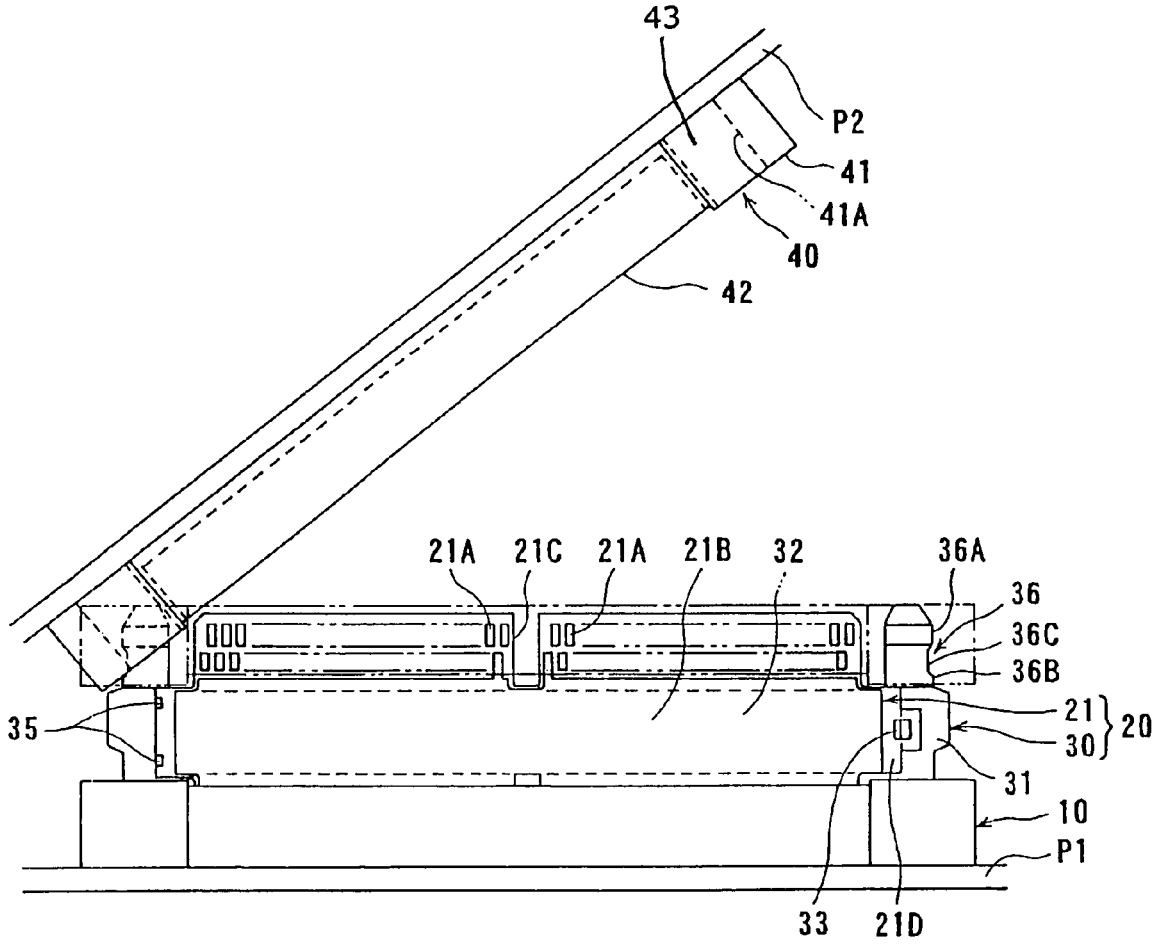
FIG. 1 is a schematic illustration of two connectors according to an embodiment of the present invention.

In FIG. 1, a connector 10, which is fixed to a circuit board P1 of an apparatus, is connected to an intermediate connector 20, and a connector 40, which is attached to another circuit board P2, is detachably plugged into the intermediate connector 20 for connection. The connectors 10 and 40, which are attached to the circuit boards P1 and P2, respectively, are made substantially identical.

Figure 6:
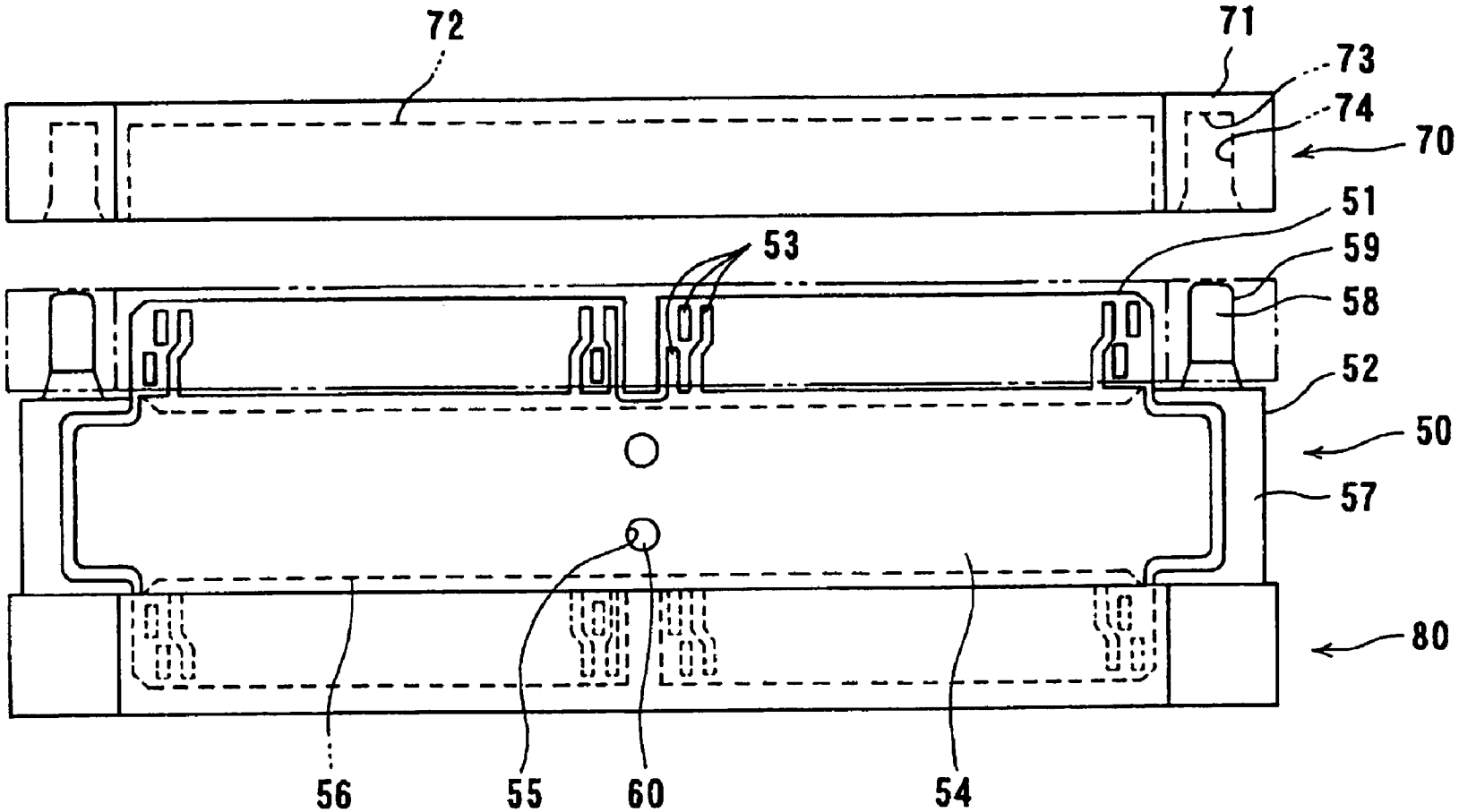
FIG. 6 PRIOR ART
FIG. 6 is a schematic illustration of a conventional connector.
Figure 7:
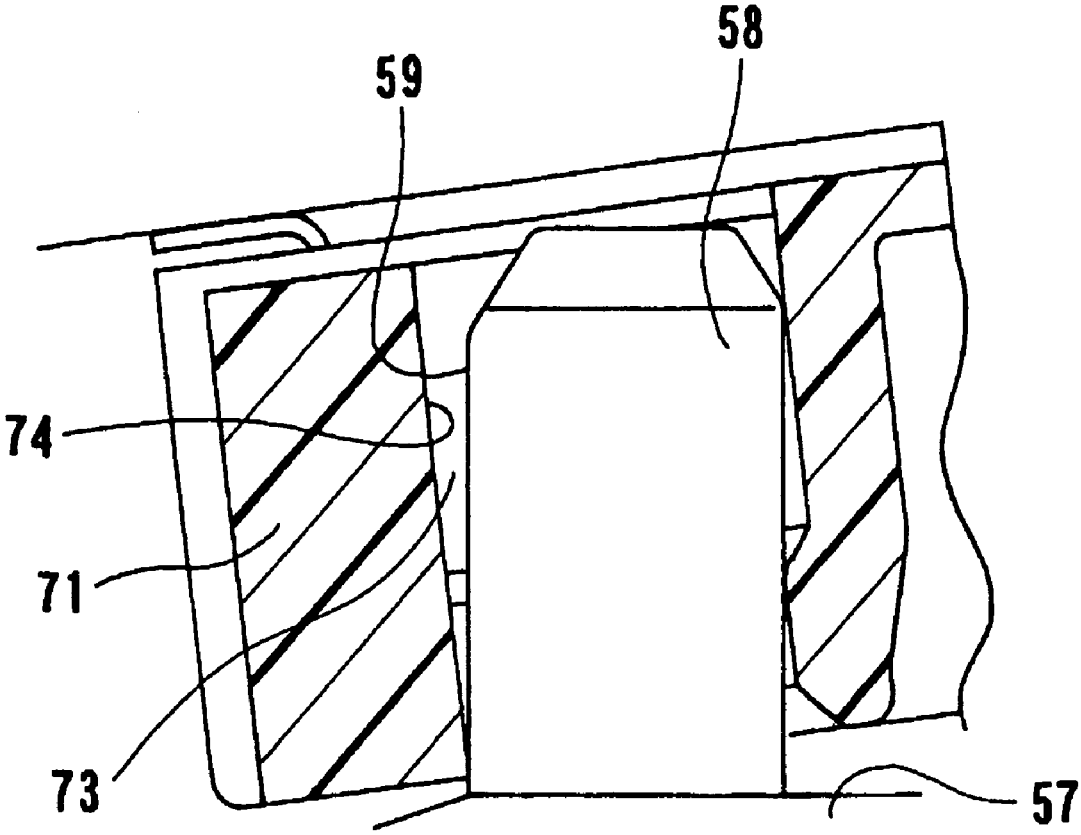
FIG. 7 PRIOR ART
FIG. 7 is an enlarged sectional view of guide and guided portions of the connector of FIG. 6.

The intermediate connector 20 comprises an intermediate board 21 and a guide frame 30 for holding the intermediate board 21. The intermediate board 21 is similar to the conventional one shown in FIG. 6 and comprises a plurality of contact portions 21A (contact pads) arranged in two rows along the upper and lower edges of both sides of the board and an inner layer having signal circuits (not shown) connected to the corresponding contact portions 21A. Also, the intermediate board 21 comprises a shield 21B, as an external layer, to cover the signal circuits. The shield 21B is electrically connected to some of the contact portions 21A. A pair of cut-off grooves 21C are provided in the center in the longitudinal direction (lateral direction in FIG. 1) of the intermediate board for absorbing a clearance between the intermediate board and the guide frame 30 by a guide (not shown) of the connector 40 and for positioning the contact portions 21A. The intermediate board 21 further comprises a supported portion 21D projecting outwardly in the longitudinal direction thereof from the arrangement area of the contact portions 21A. The intermediate board 21 is supported by the guide frame 30 at the supported portion 21D.

The intermediate board 21 is made substantially symmetric vertically and the lower contact portions are connected to the connector 10.

In this embodiment, the intermediate connector 20 has a means for locking the intermediate connector 20 and the connector 10 for tight connection. However, it is possible to arrange the connector 10, like the connector 40 described later, to be detachably attached to the intermediate connector 20. In this case, the connector 10 attached to the circuit board P1 can be removed from the intermediate connector 20.

The guide frame 30 comprises a pair of columns 31 provided at sides in the longitudinal direction of the intermediate board 21 and extending vertically, and a substantially plate-like support portion 32 linking the middle sections of the columns 31. The guide frame 30 has supporting surfaces extending in parallel to the sheet of the drawing and supporting the intermediate board 21. A resilient claw 33 is provided at one of joint areas between the support portion 32 and the columns 31 for engaging the supported portion 21D, thus positioning the intermediate board 21. Supporting claws 35 are provided on the opposite side of the resilient claw 33 for holding the intermediate board 21 placed at a predetermined position by the resilient claw 33 and supported by the support portion 32.

The intermediate board 21, and the support portion 32 and the supporting claws 35 of the guide frame 30 may be identical with conventional ones.

The columns 31 of the guide frame 30 have a pair of guide portions 36 projecting outside the range of the supported portion 21D in the vertical direction of the intermediate board 21. In the present invention, the guidance of the connector 40 by the guide portions 36 is unique. The pair of the guide portions 36 provided at the right and left columns 31 are made symmetric laterally.

Figure 2A:
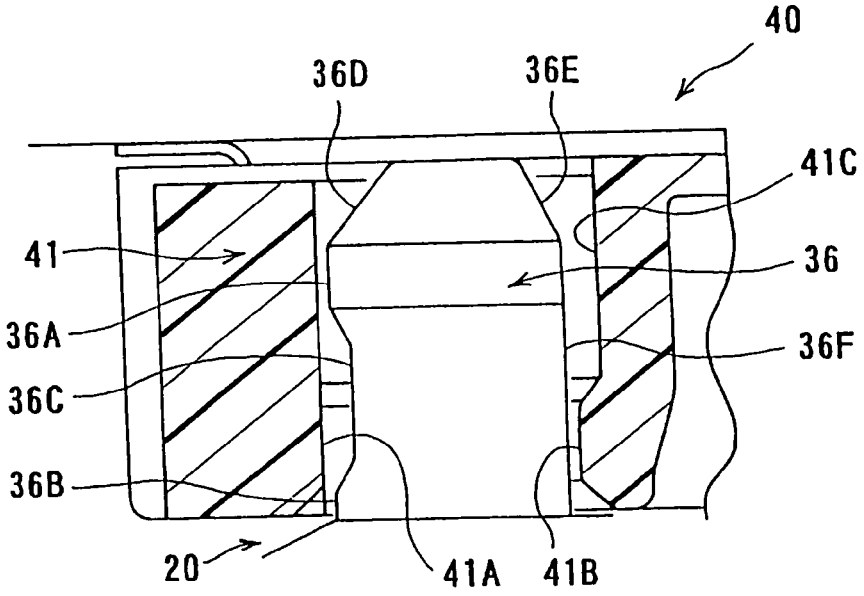

In FIG. 2(A), the guide portion 36 has two flat guide surfaces 36A and 36B on the left side there of and a relief recess 36C between the two guide surfaces 36A and 36B. The guide portion 36 has tapers 36D and 36E on the left and right tops thereof, and a flat face 36F under the taper 36E on the right side thereof.

As shown in FIG. 1, the connector 40 has a pair of guided portions 41 at the right and left sides of the housing and a accommodation groove 42 in the middle thereof, in which a plurality of contact portions (not shown) are arranged. The accommodation groove 42 receives the intermediate board 21 of the intermediate connector 20 from the upper edge of the intermediate board 21. The contact portions of the connector 20 ride on the intermediate board 21 and are brought into resilient contact with the corresponding contact portions 21 on both sides of the intermediate board 21.

A guided hole 43 is provided in the guided portion 42. For example, in FIG. 2(A), the left guided portion 41 has a flat guided surface 41A on the outside, a flat guided surface 41B in the lower part of the inside, and a relief portion 41C above the flat guided surface 41B. The outside flat guided surface 41A is positioned in close to the guide surfaces 36A and 36B of the intermediate connector 20 and the inside flat guided surface 41B is in close to the flat face 36F of the intermediate connector 20.

The connector 40 is connected to a circuit board having a plane extending in a direction perpendicular to the sheet. The connector 40 is electrically connected to the connector 10 through the intermediate connector 20. The connector 10 has a substantially identical structure with the connector 40 and is disposed in a vertically symmetrical position with the connector 40. As described above, the connector 10 is usually locked with the intermediate connector 20 by the locking means of the intermediate connector 20 for tight connection between the two. However, it can be arranged that no locking means is provided in the intermediate connector 20 and the connector 10 is removed from the intermediate connector 20 in the same way as the connector 40.

The outside and inside guided surfaces 41A and 41B of the connector 40 are guided to the respective plugging positions by the tapers 36D and 36E of the intermediate connector 20 and, then, plugged at the proper plugging position with the guidance of the guide surfaces 36A and 36B and the flat face 36F, thus the respective connection portions of the terminals are connected to each other.

When removing the connector 40 from the intermediate connector 20, it is preferred that the right and left guided-portions 41 are pulled out from the right and left guide portions 36 simultaneously. Actually, however, it frequently happens that the two guided portions 41 are pulled up alternately to larger extent, which applies undesirable gouging force to the guide and guided portions 36 and 41.

In the present invention, when the left guided portion 41 of the connector 40 shown in FIG. 2(A) is pulled up even only a little with respect to the left guide portion 36 of the intermediate connector, the lower edge of the outside guided surface 41A of the guided portion 36 drops in the relief recess 36C of the guide portion 36 so that the right guided portion 41 of the intermediate connector 40 is inclined largely and lifted up from the guide portion 36. Then, when the right guided portion 41 is pulled up with respect to the right guide portion 36, the left guided portion 41 is lifted up largely from the left guide portion 36 for the same reason. Thus, in the present invention, when the right and left guided portions 41 are pulled up alternately by gouging way, the guided portions are inclined largely. Accordingly, one of the guide portions can be pulled out from the guide portion with less number of gouging operations without any large gouging force and bite.

Figure 2B:
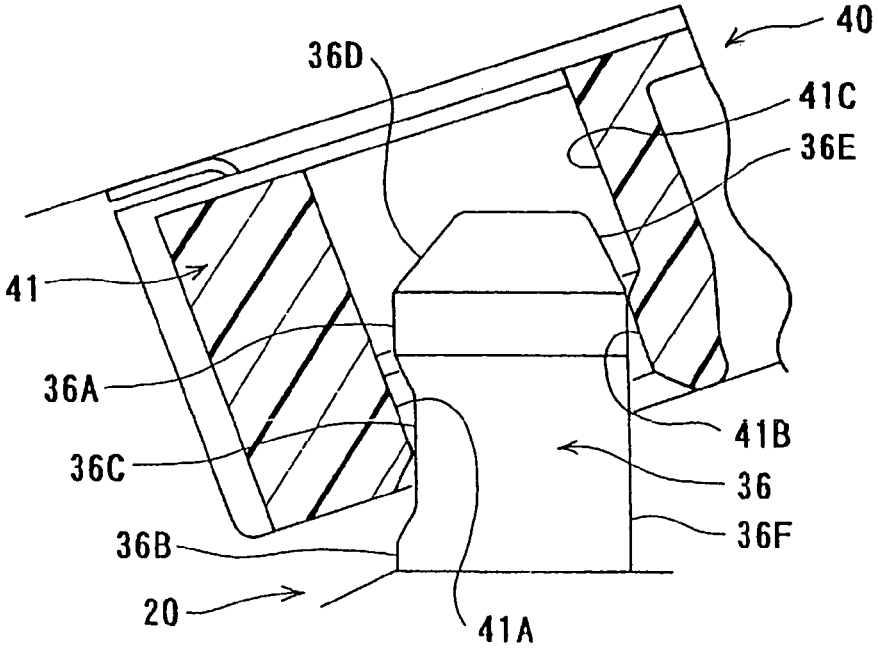

When one of the guided portions, for example, the right guided portions is pulled out from the corresponding guide portion and when, as shown in FIG. 2(B), the left guided portion 41 still engages the guide portion 36, the connector 40 can be easily removed by rotating it in counterclockwise direction as sown in FIG. 1 because the relief recess 41C is provided in the guided portion 41 and the taper 36E is provided in the guide portion 36.

In the present invention, since the guide surfaces 36A and 36B are provided with respect to the outside guided surface 41A and the flat face 36F is provided with respect to the inside guided surface 41B, the guidance and positioning of the connector 40 are firmly performed upon its plugging.

Figures 3A, 3B:
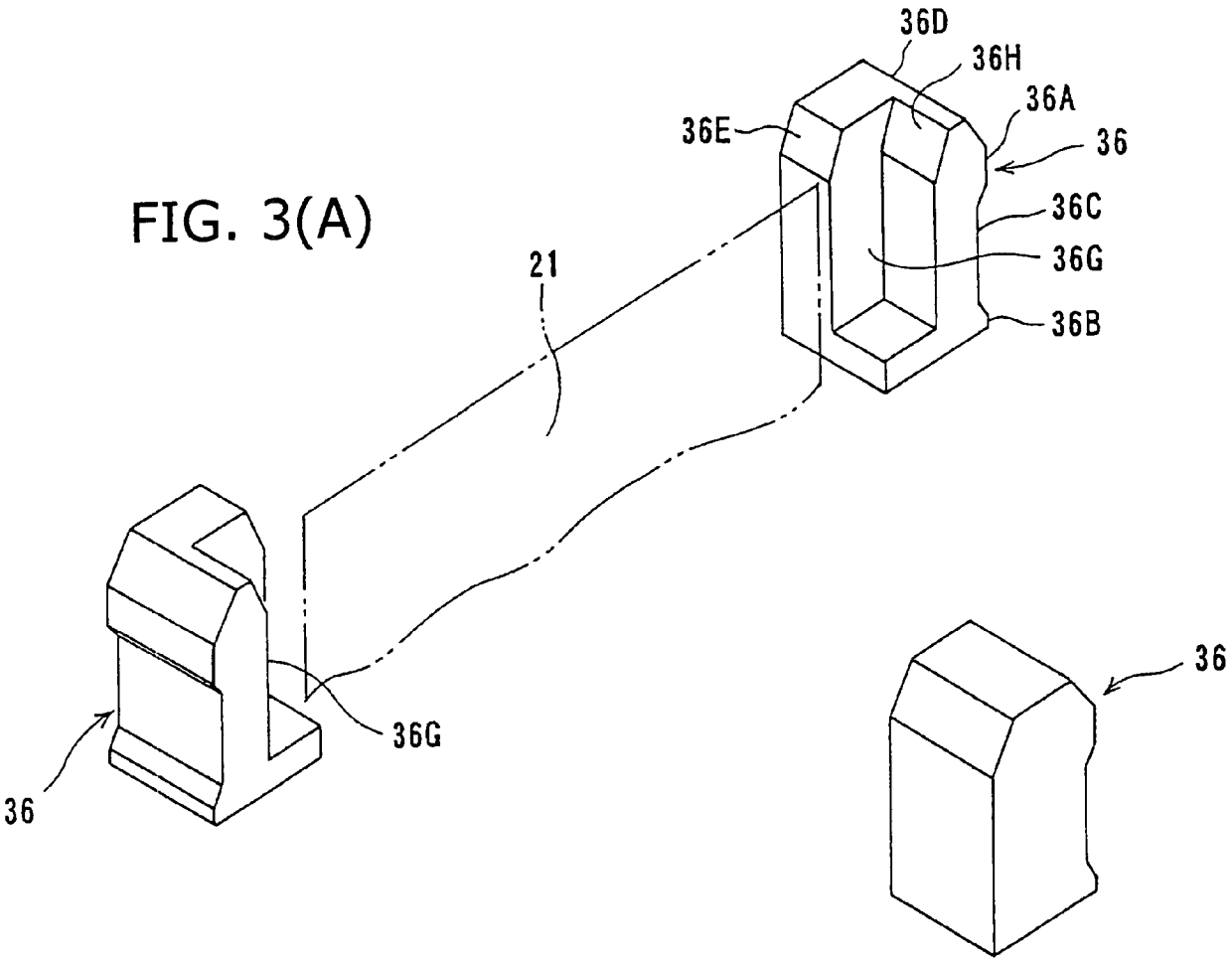
Figure 4A:
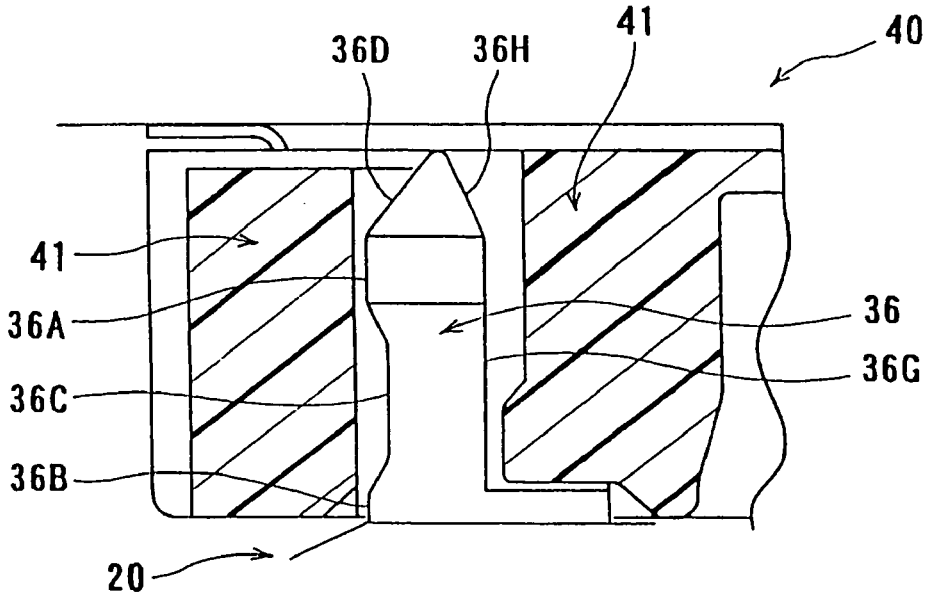
Figure 4B:
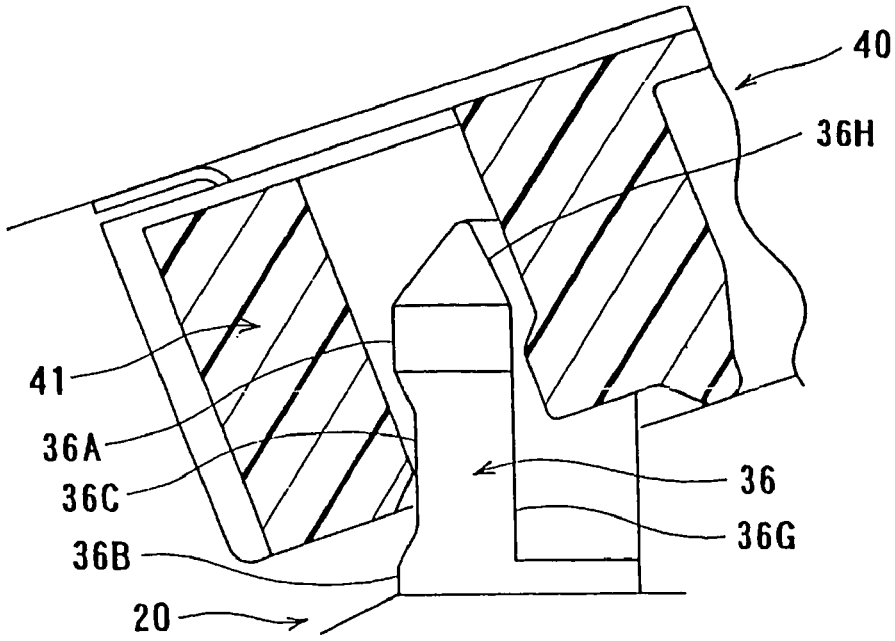
Figure 5A:
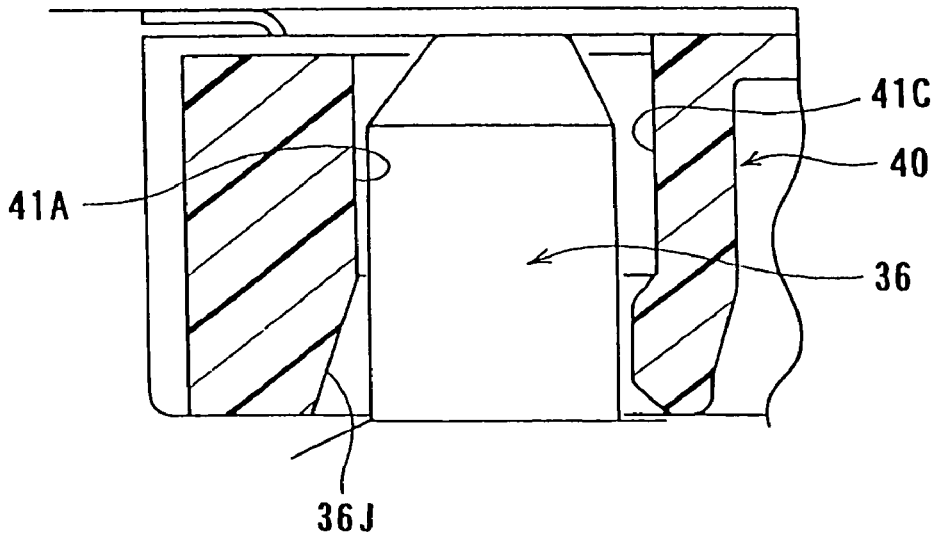
Figure 5B:
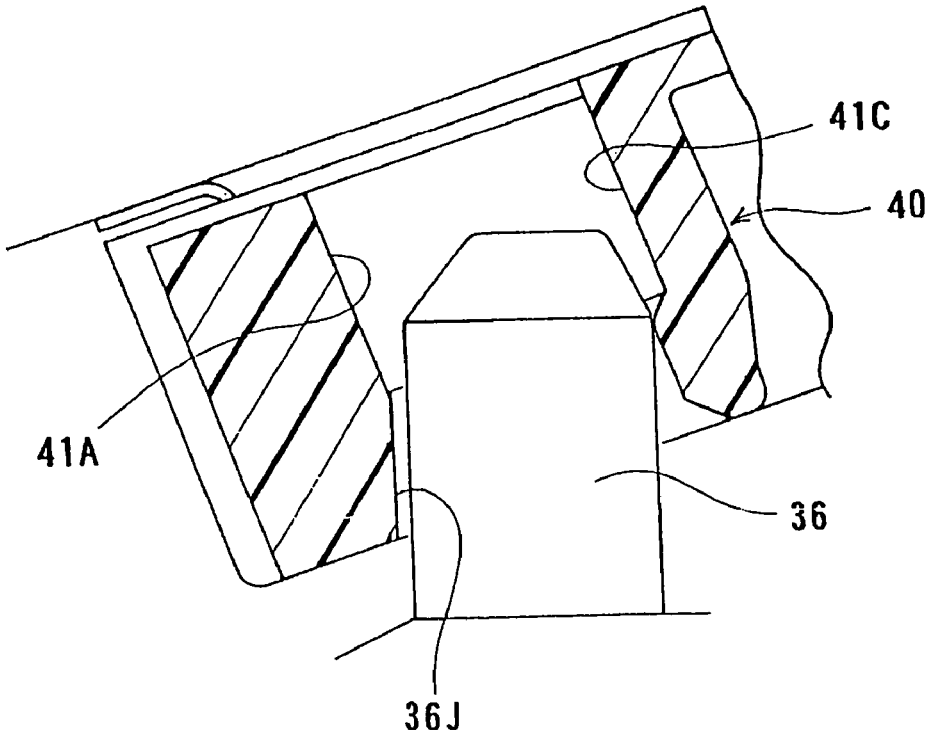

The present invention is not limited to the above-described embodiment and various modifications are possible. For example, in FIG. 3(A), the right and left guide portions 36 are asymmetric each other with respect to the plane of the intermediate board 21 of the intermediate connector so as to prevent the connector 40 from being mis-plugged into the intermediate connector 20 in the right and left direction. In FIG. 3(A), the two guide portions 36 are provided with cut-off portions 36G, respectively, and substantially L-shaped in the top view. The two guide portions 36 are symmetric with respect to the right and left direction but asymmetric with respect to the plane of the intermediate board 21. Accordingly, since the connector 40 has the corresponding holes, the connector 40 cannot be mis-plugged into the intermediate connector 40. In this embodiment too, a taper 36H is provided at the top of the cut-off portion 36G to permit large inclination of the connector 40 upon gouging-type removal shown in FIGS. 4(A) and 4(B).

Both the guide portions 36 may not be always asymmetric. For example, if the right guide portion 36 is asymmetric, the left guide portion 36 does not require the cut-off portion 36G as shown in FIG. 3(B).

In the above embodiment, the guide portion of the intermediate connector 20 and the guided portion of the connector 40 are provided with the relief recesses to enable large inclination of the connector 40. However, if either has the relief recess, it is sufficient. That is, as shown in FIGS. 1 and 2, if the relief recess 36C is provided in the guide portion 36, a sufficient inclination is obtained.

Alternatively, it is sufficient if the relief recess 41C is provided in connector 40. For example, in FIGS. 5(A) and 5(B), the relief recess 41 is provided in the guide portion of the connector 40 and only a guide surface is provided in the guided portion 36 of the intermediate connector 20. In this case, a taper 36J is provided at the lower part of the outside guided surface 41A to permit the inclination of the connector 40 together with the relief recess 41C.

According to the present invention, when a connector is removed from another connector, being gouged, since the edge portions of two guided surfaces enter relief recesses alternately, the inclination between the two connectors becomes large, thus allowing large gouging. Consequently, since the guide and guided portions do not press each other strongly, the guide and guided portions do not receive large force, the soldered portion between the connector and the circuit board is not damaged, and the edge of the guided surface does not bite the guide surface. Also, since the large inclination between the connectors reduces the number of gouging operations, thus enabling quick removal of the connector.

In addition, since the inclination between the two connectors is large, when one of the two guide portions is disengaged from one of the guided portions and the other guide portion is still in the other guided portion at the final stage of the removal operation, the connector can be rotated about the contact point between the other guide and guided portions. Accordingly, the guide and guided portions do not receive large force, thus preventing any damage on the guide portion and so forth.

The invention claimed is:

1. An electrical connector assembly, comprising:

a first connector extending in a first direction and having a pair of guide portions at both ends thereof in the first direction, each of the guide portions having a first inside surface at an inside thereof in the first direction and a first outside surface at an outside thereof in the first direction, said first inside surface having a flat surface, said first outside surface having a relief recess; and a second connector to be connected to the first connector and extending in a second direction, said second connector having a pair of guided portions at both ends thereof in the second direction for receiving the pair of the guide portions, each of the guided portions having a second inside surface at an inside thereof in the second direction and a second outside surface at an outside thereof in the second direction, said second inside surface having a relief recess, said second outside surface having a flat surface.

2. The electrical connector assembly according to claim 1, wherein each of said guided portions includes a top inside surface tapered in the second direction.

3. The electrical connector assembly according to claim 1, wherein said guide portions and said guided portions are arranged such that the relief recess of the first outside surface accommodates a part of one of the guided portions even when one of the guide portions is inserted into or pulled out from the one of the guided portions in an inclined state.

4. The electrical connector assembly according to claim 1, wherein said guide portions and said guided portions are arranged such that the relief recess of the second inside surface accommodates a part of one of the guide portions even when the one of the guide portions is inserted into or pulled out from one of the guided portions in an inclined state.

5. The electrical connector assembly according to claim 1, wherein said second connector further includes a plurality of contact portions arranged along the second direction.

6. The electrical connector assembly according to claim 5, wherein said first connector further includes an intermediate board having the contact portions disposed thereon.

7. The electrical connector assembly according to claim 6, wherein said intermediate board includes a cut-off groove for positioning the contact portions when the first connector is connected to the second connector.

* * * * *